US010907279B2

(12) United States Patent
Smith

(10) Patent No.: US 10,907,279 B2
(45) Date of Patent: Feb. 2, 2021

(54) BICOMPONENT SPANDEX WITH REDUCED FRICTION

(75) Inventor: Steven W. Smith, Waynesboro, VA (US)

(73) Assignee: The LYCRA Company LLC, Wilmington, DE (US)

( * ) Notice: Subject to any disclaimer, the term of this patent is extended or adjusted under 35 U.S.C. 154(b) by 410 days.

(21) Appl. No.: 14/128,853

(22) PCT Filed: Jul. 7, 2011

(86) PCT No.: PCT/US2011/036950

§ 371 (c)(1),
(2), (4) Date: Mar. 21, 2014

(87) PCT Pub. No.: WO2011/149734

PCT Pub. Date: Dec. 1, 2011

(65) Prior Publication Data

US 2015/0044448 A1 Feb. 12, 2015

(51) Int. Cl.

| | |
|---|---|
| ***D02G 3/32*** | (2006.01) |
| ***D01F 8/16*** | (2006.01) |
| ***D02G 3/36*** | (2006.01) |
| ***D01F 1/10*** | (2006.01) |
| *D01D 5/04* | (2006.01) |
| *D01D 5/34* | (2006.01) |

(52) U.S. Cl.

CPC ..... *D02G 3/328* (2013.01); *D01F 1/10* (2013.01); *D01F 8/16* (2013.01); *D02G 3/36* (2013.01); *D01D 5/04* (2013.01); *D01D 5/34* (2013.01); *Y10T 428/249921* (2015.04); *Y10T 428/2927* (2015.01); *Y10T 428/2929* (2015.01)

(58) Field of Classification Search

CPC ..... D01F 8/16
USPC ..... 428/373; 442/311, 361, 364, 199–200
See application file for complete search history.

(56) References Cited

U.S. PATENT DOCUMENTS

| | | | | |
|---|---|---|---|---|
| 5,162,074 | A | 11/1992 | Hills | |
| 5,256,050 | A | 10/1993 | Davies | |
| 5,849,410 | A | 12/1998 | Nelson et al. | |
| 6,352,471 | B1 * | 3/2002 | Bange | A46B 3/005 451/527 |
| 6,423,408 | B2 * | 7/2002 | Okamoto | 428/370 |
| 6,867,260 | B2 | 3/2005 | Datta et al. | |

(Continued)

FOREIGN PATENT DOCUMENTS

| | | | | |
|---|---|---|---|---|
| JP | 2005330617 | A * | 12/2005 | |
| JP | 2007077556 | A * | 3/2007 | A41B 17/00 |

(Continued)

OTHER PUBLICATIONS

International Search Report and Written Opinion Received for PCT Application No. PCT/US2011/036950, dated Feb. 9, 2012, 7 pages.

(Continued)

*Primary Examiner* — Marla D McConnell
*Assistant Examiner* — Kevin Worrell
(74) *Attorney, Agent, or Firm* — Bridget C. Sciamanna; Kathleen Tyrrell

(57) ABSTRACT

Disclosed herein are spandex fibers having reduced friction. The spandex fibers have a sheath-core cross-section with a lubricating additive is included in the sheath. A fusing additive is optionally included where a coalesced multifilament spandex yarn is desired.

23 Claims, 1 Drawing Sheet

(56) References Cited

U.S. PATENT DOCUMENTS

| | | | | |
|---|---|---|---|---|
| 2002/0086598 | A1* | 7/2002 | Velpari | H05K 1/0366 442/74 |
| 2004/0265579 | A1* | 12/2004 | Dugan | D01F 1/10 428/364 |
| 2005/0159063 | A1* | 7/2005 | Hill | A47L 13/16 442/327 |
| 2006/0135021 | A1 | 6/2006 | Calhoun et al. | |
| 2007/0122614 | A1* | 5/2007 | Peng | D01F 1/10 428/374 |
| 2008/0299856 | A1* | 12/2008 | Loubinoux | B29C 47/065 442/198 |
| 2009/0269582 | A1 | 10/2009 | Hiraishi et al. | |

FOREIGN PATENT DOCUMENTS

| | | | | |
|---|---|---|---|---|
| JP | 2007211376 | A | * | 8/2007 |
| WO | 2006/102249 | A2 | | 9/2006 |
| WO | 2007/123214 | A1 | | 11/2007 |
| WO | 2010/004515 | A1 | | 1/2010 |
| WO | 2011/149734 | A2 | | 12/2011 |

OTHER PUBLICATIONS

International Preliminary Report and Patentability Report Received for PCT Patent Application No. PCT/US2011/036950, dated Dec. 6, 2012, 6 pages.

* cited by examiner

BICOMPONENT SPANDEX WITH REDUCED FRICTION

This patent application is the U.S. National Stage of PCT/US2011/036950, filed Jul. 7, 2011.

BACKGROUND OF THE INVENTION

Field of the Invention

Included are multiple component spandex yarns that include a lubricating additive and optionally a fusing additive which provide yarns having reduced friction compared to typical spandex yarns.

Description of the Related Art

Spandex yarns are known to have a tacky surface that can cause difficulty in processing the yarns and incorporating the yarns into fabric.

Historically, silicone oil chemistry has been exploited to minimize spandex fiber friction. The inorganic siloxane backbone is the most flexible polymer backbone available. This allows the methyl groups to be arranged and presented to minimize surface energy. Consequently, polydimethylsiloxane (PDMS) provides one of the lowest-energy surfaces known (21 mN/m). This rather unique surface behavior accounts for PDMS utility and commercial application as a spandex finish.

The current spandex technology platform employs poly (dimethyl siloxane) (PDMS) to wet the surface and provide lubrication even though PDMS is generally viewed as a moderate lubricant. Furthermore, solid metallic soap is dispersed within the PDMS to reduce tack and function as a boundary lubricant. Poly(dimethyl siloxane) (PDMS) has been employed as the main lubricant on spandex yarns for decades due to extremely low level of penetration into the spandex polymer. Unfortunately silicone fluids are inferior for biodegradability as well as application deficiencies such as incompatibility with metallic salts, increased dyeing defects, and cost. Mineral oils have also been widely used by finish producers to reduce the cost impact of the silicone fluids, but such petroleum distillates exhibit penetration levels around 10% (versus ~0.1% for PDMS) leading to performance issues and changes in the spandex polymer. The novel approach of applying high levels of solid lubricant to a sheath layer has a surprising reduction in fiber friction as shown in the examples.

SUMMARY OF THE INVENTION

There is a need for improved compositions to reduce friction of spandex yarns. This has been accomplished by providing a specific spandex composition in a multiple component fiber and yarn.

Some aspects provide an article including a low-friction spandex elastomeric yarn including:

(a) a polyurethane bicomponent fiber having a core and a sheath; and (b) a lubricating additive;

wherein the elastomeric yarn is a single filament yarn or fiber.

Also provided is an article including a low-friction spandex elastomeric yarn including:

(a) a polyurethane bicomponent fiber having a core and a sheath;

(b) a lubricating additive; and (c) a fusing additive to enhance cohesive bonding between filaments;

wherein said elastomeric yarn is a multiple filament yarn.

The fusing additive is optional for the single filament yarn where cohesive bonding among filaments in the same yarn is not a concern. However, the fusing additive may also be included in either a single filament or multiple filament yarn to provide adhesive with other yarns. The fusing additive and lubricating additive provide differing properties to the surface of the yarn when included in a sheath.

DETAILED DESCRIPTION OF THE INVENTION

Definitions

Figure 1:
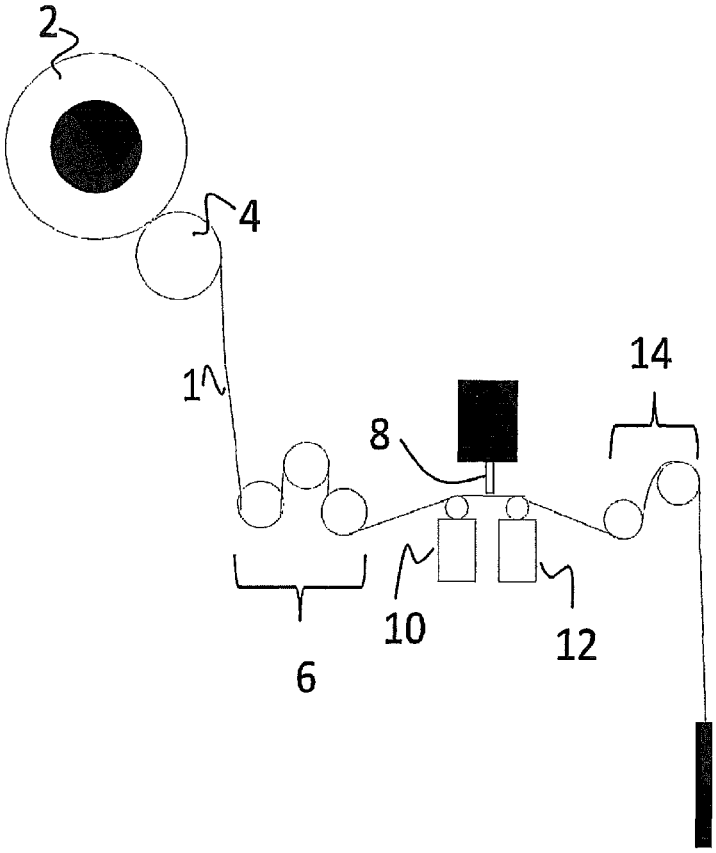
FIG. 1 is schematic of a device for measuring friction.

The term "multiple component fiber" as used herein means a fiber having at least two separate and distinct regions of different compositions with a discernable boundary, i.e., two or more regions of different compositions that are continuous along the fiber length. This is in contrast to polyurethane or polyurethaneurea blends wherein more than one composition is combined to form a fiber without distinct and continuous boundaries along the length of the fiber. The terms "multiple component fiber" and "multicomponent fiber" are synonymous and are used interchangeably herein.

The term "compositionally different" is defined as two or more compositions including different polymers, copolymers or blends or two or more compositions having one or more different additives, where the polymer included in the compositions may be the same or different. Two compared compositions are also "compositionally different" where they include different polymers and different additives.

The terms "boundary," "boundaries," and "boundary region" are used to describe the point of contact between different regions of the multicomponent fiber cross-section. This point of contact is "well-defined" where there is minimal or no overlap between the compositions of the two regions. Where overlap does exist between two regions, the boundary region will include a blend of the two regions. This blended region may be a separate homogenously blended section with separate boundaries between the blended boundary region and each of the other two regions. Alternatively, the boundary region may include a gradient of higher concentration of the composition of the first region adjacent to the first region to a higher concentration of the composition of the second region adjacent to the second region.

As used herein, "solvent" refers to an organic solvent such as N,N-dimethylacetamide (DMAC), N,N-dimethylformamide (DMF) and N-methyl pyrrolidone.

The term "solution-spinning" as used herein includes the preparation of a fiber from a solution which can be either a wet-spun or dry-spun process, both of which are common techniques for fiber production. The multiple component or bicomponent fibers may be prepared by a solution-spun process and as such may be described as solution-spun yarn.

Polyurethane and/or polyurethaneurea-based bicomponent fibers of some aspects are produced by solvent spinning with enhanced functionality by addition of solid lubricant and optionally a fusing agent to the sheath. These yarns deliver excellent uniformity, low-friction coefficient, and good inter-filament cohesion from a commercially robust process. Typical fusing additives have deleterious effects on spandex fiber properties, but implementation within a bicomponent structure where the fusing additive is in the sheath only provides greater flexibility to use high levels of solid lubricants and fusing agents.

Included are reduced friction/low friction yarns that can be used in combination with traditional finishes such as silicon or mineral oil based finishes to provide a low-friction fiber. These fibers have one or more of the following properties: high resistance to thermal creep, good elasticity, low-friction, and robust filament cohesion. These attributes are ideally suited for textile applications such as light-weight circular-knit, warp-knit and woven fabrics, but are also useful for any fabrics and garments that require an elastic yarn.

The yarns of some aspects are either single filament yarns or multiple filament yarns. The yarns include a lubricating additive which contributes to the reduced friction property. The multiple filament yarns also include a fusing additive. The purpose of the fusing additive is to enhance or provide cohesion among filaments in a multiple filament yarn. The fusing additive is optional for the single filament yarn and may be included to promote adhesion between the single filament and other yarns.

The lubricating additive is chosen from those that may provide a lubricating effect to fibers. Examples of solid lubricants include crystalline materials which shear into thin, flat platelets and readily slide over one another to produce a lubricating effect. Examples include mica, graphite, carbon black, molybdenum disulfide, talc, boron nitride, and mixtures thereof.

Also included are highly electronegative polymers such as a fluorine-containing polymer. These can be low friction polymers, such as PTFE which is widely used to reduce friction.

Talcs may be hydrated magnesium silicates frequently including aluminium silicate. The crystal structure of talc may include of repeated layers of a sandwich of brucite (magnesium hydroxide) between layers of silica.

Micas may include aluminium silicates and optionally include iron and/or alkali metals. Micas are able to divide into thin layers (about 1 μm). They generally range in size from 5 to 150 μm, preferably from 10 to 100 μm and better still from 10 to 60 μm for the largest size (length), and a height (thickness) of from 0.1 to 0.5 μm. The micas may include phlogopite, muscovite, fluorophiogopite vermiculite, micaceous clays such as illite, and mixtures thereof.

The bicomponent fibers of some aspects can include a wide range of ratio of the first region (core) to the second region (sheath). The sheath in a sheath-core configuration, can be present in an amount from about 1% to about 60% based on the weight of the fiber including from about 1% to about 50% by weight of the fiber, from about 10% to about 35% by weight of the fiber, about 10% to about 20%, about 10% to about 15% and from about 5% to about 30% by weight of the fiber. Where desired to limit the effect of the sheath on the elastic properties of the core, the sheath may be minimized.

The fusing additives may include low-melting polyurethanes or adhesives to enhance cohesion in a multifilament fiber. Examples of suitable materials include, but are not limited to, moisture-curing, thermo-bonding, and hot-melt adhesives including reactive hot melts. This includes linear thermoplastic polyurethanes based on polyether, polyester, polycarbonate, and polycaprolactone, or blends thereof. Sample commercial products include Mor-Melt (R-5022) (Rohm and Haas), Pellathane® 2103C (Dow), Desmopan® 5377, 9375AHM (Bayer Material Science), Pearlbond 104, 106,122,123 (Merquinsa Mercados Químicos, S.L), TPUA-252A (TPUCO, Taiwan).

The amounts of the lubricating additive and fusing additive may vary. The fusing additive and lubricating additive can be used either alone, or in combination with a polyurethane or polyurethaneurea composition and/or additional polymers and additives. The lubricating additive may be present in an amount from about 1% to about 25% by weight of the sheath, including about % 5 to about 20%, and about 10% to about 15%. The fusing additive may be present in an amount of about 25% to about 75%, including about 50% to about 70%, and about 60% to about 65%.

Some aspects include multi-component, or bicomponent fibers including a solution-spun polymer composition. A variety of different compositions are suitable including a polyurethane, a polyurethaneurea or a mixture thereof. The compositions for the different regions of the multi-component fibers include different polyurethane or polyurethaneurea compositions in that the polymer is different, the additives are different, or both the polymer and additives are different. By providing a multiple component fiber, a variety of different benefits can be realized. For example, reduced cost due to use of additives or a more expensive polyurethaneurea composition in only one region of the fiber while maintaining comparable properties. Also, improved fiber properties can be realized by the introduction of new additives that would be incompatible with a conventional monocomponent spandex yarn or through a synergistic effect of combining two compositions.

The fiber breaking strength as measured in grams of force to break per unit denier (tenacity in grams/denier) may be adjusted from 0.7 to 1.2 grams/denier dependent on molecular weight and/or spinning conditions.

The denier of the fiber may be produced from 5-2000 based on the desired fabric construction. A spandex yarn of denier 5-70 denier and may have a filament count of between 1 and 5, and a yarn of denier 70-2000 may have a filament count from 5 to 200, including from 20 to 200. The fiber may be used in fabrics of any sort (wovens, warp knits, or weft knits) in a content from 0.5% to 100% depending on the desired end use of the fabric.

The spandex fiber may have a lubricant or finish applied to it during the manufacturing process to improve downstream processing of the fiber. The finish, such as a silicone or mineral oil-based finish, may be applied in a quantity of 0.5 to 10% by weight.

Polyurethaneurea and Polyurethane Compositions

A variety of different polyurethane or polyurethaneurea compositions are useful with the present invention in either or both of the first and second regions (i.e, the core and the sheath, respectively). Additional regions may also be included. Useful polyurethane/polyurethaneurea compositions are described in detail below.

The properties of polyurethane block copolymers depend on phase separation of the urethane and polyol segments, such that the hard urethane domains serve as crosslinks in the soft-segment matrix. The urethane domain is controlled by both content and quality of the selected chain extender. When the chain extender is a diol, the result is a polyurethane; when the chain extender is water or a diamine, the result is a polyurethaneurea.

Commercial diol chain extenders useful for the preparation of high melting point polyurethanes include, without limitation, ethylene glycol, 1,3-propanediol (PDO), 1,4-butanediol (1,4-BDO or BDO), and 1,6-hexanediol (HDO).

All of these diol chain extenders form polyurethanes that phase separate well and form well defined hard segment domains and are all suitable for thermoplastic polyurethanes with the exception of ethylene glycol. Table 1 lists typical hard-segment melting ranges for the polyurethanes derived from some common chain extenders. Processing temperatures above 200° C. are unfavorable for common TPU compositions due to thermal degradation during processing and concomitant loss of properties. Additionally, PU derived from high hard-segment melting compositions traditionally yield improved elasticity and thermal resilience and are more desirable for textile processing. Such polyurethane fibers with high hard-segment melting point can only be produced from traditional solution spinning processes to yield superior stretch/recovery properties.

TABLE 1

DSC Assignments for Hard-Segment Polymorphic Structures

| Chain extender | Endotherm (° C.) |
|---|---|
| 1,6-Hexanediol (HDO) | 180-190 |
| 1,4-Butanediol (BDO) | 205-215 |
| 1,3-Propanediol (PDO) | 210-225 |
| Ethylene glycol (EDO) | 245-260 |

The hard segment melting temperature of a segmented polyurethane or polyurethaneurea polymer, in a form of pellet, film or fiber, is measured by a differential scanning calorimeter, such as DSC 2010 from TA Instruments. Typically, a sample size of 3 to 10 milligrams sealed in an aluminum pan is used. A temperature range from the ambient temperature to 350° C. is scanned with a ramping rate of 10° C. per minute and with nitrogen purge in the DSC cell. The peak position of the hard segment melting transition of the polymer is taken as the melting temperature of the polymer hard segments.

Polyurethaneurea compositions useful for preparing fiber are long chain synthetic polymers that include at least 85% by weight of a segmented polyurethane. Typically, these include a polymeric glycol, also referred to as a polyol, which is reacted with a diisocyanate to form an NCO-terminated prepolymer (a "capped glycol"), which is then dissolved in a suitable solvent, such as N,N-dimethylacetamide, N,N-dimethylformamide, or N-methylpyrrolidone, and secondarily reacted with a difunctional chain extender. Polyurethanes are formed when the chain extenders are diols (and may be prepared without solvent). Polyurethaneureas, a sub-class of polyurethanes, are formed when the chain extenders are diamines. In the preparation of a polyurethaneurea polymer which can be spun into spandex, the glycols are extended by sequential reaction of the hydroxy end groups with diisocyanates and one or more diamines. In each case, the capped glycols must undergo chain extension to provide a polymer with the necessary properties, including viscosity. If desired, dibutyltin dilaurate, stannous octoate, mineral acids, tertiary amines such as triethylamine, N,N'-dimethylpiperazine, and the like, and other known catalysts can be used to assist in the capping step.

Suitable polymeric glycol components include polyether glycols, polycarbonate glycols, and polyester glycols of number average molecular weight of about 600 to about 3,500. Mixtures of two or more polymeric glycol or copolymers can be included.

Examples of polyether glycols that can be used include those glycols with two or more hydroxy groups, from ring-opening polymerization and/or copolymerization of ethylene oxide, propylene oxide, trimethylene oxide, tetrahydrofuran, and 3-methyltetrahydrofuran, or from condensation polymerization of a polyhydric alcohol, such as a diol or diol mixtures, with less than 12 carbon atoms in each molecule, such as ethylene glycol, 1,3-propanediol, 1,4-butanediol, 1,5-pentanediol 1,6-hexanediol, 2,2-dimethyl-1,3 propanediol, 3-methyl-1,5-pentanediol, 1,7-heptanediol, 1,8-octanediol, 1,9-nonanediol, 1,10-decanediol and 1,12-dodecanediol. A linear, bifunctional polyether polyol is preferred, and a poly(tetramethylene ether)glycol of molecular weight of about 1,700 to about 2,100, such as Terathane® 1800 (INVISTA of Wichita, Kans.) with a functionality of 2, is one example of a specific suitable glycols. Co-polymers can include poly(tetramethyleneether-co-ethyleneether) glycol.

Examples of polyester polyols that can be used include those ester glycols with two or more hydroxy groups, produced by condensation polymerization of aliphatic polycarboxylic acids and polyols, or their mixtures, of low molecular weights with no more than 12 carbon atoms in each molecule. Examples of suitable polycarboxylic acids are malonic acid, succinic acid, glutaric acid, adipic acid, pimelic acid, suberic acid, azelaic acid, sebacic acid, undecanedicarboxylic acid, and dodecanedicarboxylic acid. Examples of suitable polyols for preparing the polyester polyols are ethylene glycol, 1,3-propanediol, 1,4-butanediol, 1,5-pentanediol 1,6-hexanediol, neopentyl glycol, 3-methyl-1,5-pentanediol, 1,7-heptanediol, 1,8-octanediol, 1,9-nonanediol, 1,10-decanediol and 1,12-dodecanediol. A linear bifunctional polyester polyol with a melting temperature of about 5° C. to about 50° C. is an example of a specific polyester polyol.

Examples of polycarbonate polyols that can be used include those carbonate glycols with two or more hydroxy groups, produced by condensation polymerization of phosgene, chloroformic acid ester, dialkyl carbonate or diallyl carbonate and aliphatic polyols, or their mixtures, of low molecular weights with no more than 12 carbon atoms in each molecule. Examples of suitable polyols for preparing the polycarbonate polyols are diethylene glycol, 1,3-propanediol, 1,4-butanediol, 1,5-pentanediol, 1,6-hexanediol, neopentyl glycol, 3-methyl-1,5-pentanediol, 1,7-heptanediol, 1,8-octanediol, 1,9-nonanediol, 1,10-decanediol and 1,12-dodecanediol. A linear, bifunctional polycarbonate polyol with a melting temperature of about 5° C. to about 50° C. is an example of a specific polycarbonate polyol.

The diisocyanate component can also include a single diisocyanate or a mixture of different diisocyanates including an isomer mixture of diphenylmethane diisocyanate (MDI) containing 4,4'-methylene bis(phenyl isocyanate) and 2,4'-methylene bis(phenyl isocyanate). Any suitable aromatic or aliphatic diisocyanate can be included. Examples of diisocyanates that can be used include, but are not limited to 4,4'-methylene bis(phenyl isocyanate), 2,4'-methylene bis (phenyl isocyanate), 4,4'-methylenebis(cyclohexyl isocyanate), 1,3-diisocyanato-4-methyl-benzene, 2,2'-toluenediisocyanate, 2,4'-toluenediisocyanate, and mixtures thereof.

A chain extender may be either water or a diamine chain extender for a polyurethaneurea. Combinations of different chain extenders may be included depending on the desired properties of the polyurethaneurea and the resulting fiber. Examples of suitable diamine chain extenders include: hydrazine; 1,2-ethylenediamine; 1,4-butanediamine; 1,2-butanediamine; 1,3-butanediamine; 1,3-diamino-2,2-dimethylbutane; 1,6-hexamethylenediamine; 1,12-dodecanediamine; 1,2-propanediamine; 1,3-propanediamine; 2-methyl-1,5-pentanediamine; 1-amino-3,3,5-trimethyl-5-aminomethylcyclohexane; 2,4-diamino-1-methylcyclohexane; N-methylamino-bis(3-propylamine); 1,2-cyclohexanediamine; 1,4-cyclohexanediamine; 4,4'-methylene-bis(cyclohexylamine); isophorone diamine; 2,2-dimethyl-1,3-propanediamine; meta-tetramethylxylenediamine; 1,3-diamino-4-methylcyclohexane; 1,3-cyclohexane-diamine; 1,1-methylene-bis(4,4'-diaminohexane); 3-aminomethyl-3,5,5-trimethylcyclohexane; 1,3-pentanediamine (1,3-diaminopentane); m-xylylene diamine; and Jeffamine® (Huntsman).

When a polyurethane is desired, the chain extender is a diol. Examples of such diols that may be used include, but are not limited to, ethylene glycol, 1,3-propanediol, 1,2-propylene glycol, 3-methyl-1,5-pentanediol, 2,2-dimethyl-1,3-propanediol, 2,2,4-trimethyl-1,5-pentanediol, 2-methyl-2-ethyl-1,3-propanediol, 1,4-bis(hydroxyethoxy)benzene, and 1,4-butanediol, hexanediol and mixtures thereof.

A monofunctional alcohol or a primary/secondary monofunctional amine may optionally be included to control the molecular weight of the polymer. Blends of one or more monofunctional alcohols with one or more monofunctional amines may also be included.

Examples of monofunctional alcohols useful in some aspects include at least one member selected from the group consisting of aliphatic and cycloaliphatic primary and secondary alcohols with 1 to 18 carbons, phenol, substituted phenols, ethoxylated alkyl phenols and ethoxylated fatty alcohols with molecular weight less than about 750, including molecular weight less than 500, hydroxyamines, hydroxymethyl and hydroxyethyl substituted tertiary amines, hydroxymethyl and hydroxyethyl substituted heterocyclic compounds, and combinations thereof, including furfuryl alcohol, tetrahydrofurfuryl alcohol, N-(2-hydroxyethyl) succinimide, 4-(2-hydroxyethyl)morpholine, methanol, ethanol, butanol, neopentyl alcohol, hexanol, cyclohexanol, cyclohexanemethanol, benzyl alcohol, octanol, octadecanol, N,N-diethylhydroxylamine, 2-(diethylamino)ethanol, 2-dimethylaminoethanol, and 4-piperidineethanol, and combinations thereof.

Examples of suitable mono-functional dialkylamine blocking agents include: N,N-diethylamine, N-ethyl-N-propylamine, N,N-diisopropylamine, N-tert-butyl-N-methylamine, N-tert-butyl-N-benzylamine, N,N-dicyclohexylamine, N-ethyl-N-isopropylamine, N-tert-butyl-N-isopropylamine, N-isopropyl-N-cyclohexylamine, N-ethyl-N-cyclohexylamine, N,N-diethanolamine, and 2,2,6,6-tetramethylpiperidine.

Examples of suitable core polymers include:

1) a polyurethane with a high melting point ranging from 200° C. to 250° C. or, 2) a blend of at least one polyurethane and at least one polyurethane-urea or, 3) a polyurethane-urea with a melting point greater than 240° C.

Other Polymers

Other polymers that are useful for inclusion in one or more regions of the multiple component fibers of some aspects include other polymers which are soluble or have limited solubility or can be included in particulate form (e.g., fine particulate). The polymers may be dispersed or dissolved in the polyurethane or -polyurethaneurea solution or coextruded with the solution spun-polyurethane or polyurethaneurea composition. The result of co-extrusion can be a bicomponent or multiple component fiber having a side-by-side, concentric sheath-core, or eccentric sheath-core cross-section where one component is polyurethaneurea solution and the other component contains another polymer. Examples of other polymers include low-melting polyurethanes (as described above), polyamides, acrylics, polyaramides, and polyolefins, among others.

Other polymers that can be included in the multiple component fibers and/or bicomponent fibers of the present invention include other semicrystalline insoluble polymers included as a particulate form. Useful polyamides include nylon 6, nylon 6/6, nylon 10, nylon 12, nylon 6/10, and nylon 6/12. Polyolefins include polyolefins prepared from $C_2$ to $C_{20}$ monomers. This includes copolymers and terpolymers such as ethylene-propylene copolymers. Examples of useful polyolefin copolymers are disclosed in U.S. Pat. No. 6,867,260 to Datta et al., incorporated herein by reference.

Fiber Cross-Section Configurations

A variety of different cross-sections are useful with the invention of some embodiments. These include bicomponent or multiple component concentric or eccentric sheath-core and bicomponent or multiple component side-by-side. Unique cross-sections are contemplated, so long as the cross-sections will include at least two separate regions. Alternative cross-sections may have a pie-slice configuration or similar to an eccentric sheath-core, where the sheath only partially surrounds the core. In other words, a second region of the cross section may partially or completely surround the first region. Most frequently, a sheath-core cross-section will be included. The fusing additive and lubricating additives may be included in either the sheath (second region) or core (first region), but will most favorably affect the cohesive and low-friction properties, respectively when located in the sheath.

Each of the sheath-core cross-sections includes a boundary area between at least two compositionally different polyurethaneurea compositions. The boundary may be a well-defined boundary or may include a blended region. Where the boundary includes a blended region, the boundary itself is a distinct region which is a blend of the compositions of the first and second (or third, fourth, etc.) regions. This blend may be either a homogenous blend or may include a concentration gradient from the first region to the second region.

Additives

Classes of additives that may be optionally included in polyurethane or polyurethaneurea compositions are listed below. An exemplary and non-limiting list is included. However, additional additives are well-known in the art. Examples include: anti-oxidants, UV stabilizers, colorants, pigments, cross-linking agents, phase change materials (paraffin wax), antimicrobials, minerals (i.e., copper), microencapsulated additives (i.e., aloe vera, vitamin E gel, aloe vera, sea kelp, nicotine, caffeine, scents or aromas), nanoparticles (i.e., silica or carbon), nano-clay, calcium carbonate, talc, flame retardants, antitack additives, chlorine degradation resistant additives, vitamins, medicines, fragrances, electrically conductive additives, dyeability and/or dye-assist agents (such as quaternary ammonium salts). Other additives which may be added to the polyurethane or polyurethaneurea compositions include adhesion promoters, antistatic agents, anti-creep agents, optical brighteners, coalescing agents, electroconductive additives, luminescent additives, organic and inorganic fillers, preservatives, texturizing agents, thermochromic additives, insect repellants, and wetting agents, stabilizers (hindered phenols, zinc oxide, hindered amine), slip agent (silicone oil) and combinations thereof.

The additive may provide one or more beneficial properties including: dyeability, hydrophobicity (i.e., polytetrafluoroethylene (PTFE)), hydrophilicity (i.e., cellulose), friction control, chlorine resistance, degradation resistance (i.e., antioxidants), adhesiveness and/or fusibility (i.e., adhesives and adhesion promoters), flame retardance, antimicrobial behavior (silver, copper, ammonium salt), barrier, electrical conductivity (carbon black), tensile properties, color, luminescence, recyclability, biodegradability, fragrance, tack control (i.e., metal stearates), tactile properties, settability, thermal regulation (i.e., phase change materials), nutriceutical, delustrant such as titanium dioxide, stabilizers such as hydrotalcite, a mixture of huntite and hydromagnesite, UV screeners, and combinations thereof.

Additives may be included in any amount suitable to achieve the desired effect.

Apparatus

Bicomponent fibers have been typically prepared by a melt-spinning process. The apparatuses used for these processes can be adapted for use with a solution-spinning process. Dry-spinning and wet-spinning are solution-spinning processes that are well-known.

Convenient references relating to fibers and filaments, including those of man-made bicomponent fibers, and incorporated herein by reference, are, for example:

a. Fundamentals of Fibre Formation—The Science of Fibre Spinning and Drawing, Adrezij Ziabicki, John Wiley and Sons, London/New York, 1976;

b. Bicomponent Fibres, R Jeffries, Merrow Publishing Co. Ltd, 1971;

c. Handbook of Fiber Science and Technology, T. F. Cooke, CRC Press, 1993;

Similar references include U.S. Pat. Nos. 5,162,074 and 5,256,050 incorporated herein by reference, which describes methods and equipment for bicomponent fiber production.

Extrusion of the polymer through a die to form a fiber is done with conventional equipment such as, for example, extruders, gear pumps and the like. It is preferred to employ separate gear pumps to supply the polymer solutions to the die. When blending additives for functionality, the polymer blend is preferably mixed in a static mixer, for example, upstream of the gear pump in order to obtain a more uniform dispersion of the components. Preparatory to extrusion each spandex solution can be separately heated by a jacketed vessel with controlled temperature and filtered to improve spinning yield.

The bicomponent spandex fibers may also be prepared by separate capillaries to form separate filaments which are subsequently coalesced to form a single fiber.

Process of Making Fibers

The fiber of some embodiments is produced by solution spinning (either wet-spinning or dry spinning) of the-polyurethane or polyurethane-urea polymer from a solution with conventional urethane polymer solvents (e.g., DMAc). The polyurethane or polyurethaneurea polymer solutions may include any of the compositions or additives described above. The polymer is prepared by reacting an organic diisocyanate with appropriate glycol, at a mole ratio of diisocyanate to glycol in the range of 1.6 to 2.3, preferably 1.8 to 2.0, to produce a "capped glycol". The capped glycol is then reacted with a mixture of diamine chain extenders. In the resultant polymer, the soft segments are the polyether/urethane parts of the polymer chain. These soft segments exhibit melting temperatures of lower than 60° C. The hard segments are the polyurethane/urea parts of the polymer chains; these have melting temperatures of higher than 200° C. The hard segments amount to 5.5 to 12%, preferably 6 to 10%, of the total weight of the polymer. A polyurethane polymer is prepared by reacting an organic diisocyanate with appropriate glycol, at a mole ratio of diisocyanate to glycol in the range of 2.2 to 3.3, preferably 2.5 to 2.95, to produce a "capped glycol". The capped glycol is then reacted with a mixture of diol chain extenders. The hard segments are the polyurethane segments of the polymer chains; these have melting temperatures ranging from 150-240° C. The hard segments can constitute 10 to 20%, preferably 13, of the total weight of the polymer.

In one embodiment of preparing fibers, the polymer solutions containing 30-40% polymer solids are metered through desired arrangement of distribution plates and orifices to form filaments. Distribution plates are arranged to combine polymer streams in a one of concentric sheath-core, eccentric sheath-core, and side-by-side arrangement followed by extrusion thru a common capillary. Extruded filaments are dried by introduction of hot, inert gas at 300° C.-400° C. and a gas:polymer mass ratio of at least 10:1 and drawn at a speed of at least 400 meters per minute (preferably at least 600 m/min) and then wound up at a speed of at least 500 meters per minute (preferably at least 750 m/min). All examples given below were made with 80° C. extrusion temperature in to a hot inert gas atmosphere at a take-up speed of 762 m/min. Standard process conditions are well-known in the art.

Yarns formed from elastic fibers made in accordance with the present invention generally have a tenacity at break of at least 0.6 cN/dtex, a break elongation of at least 400%, an unload modulus at 300% elongation of at least 27 mg/dtex.

Yarns and fabrics can be prepared from the elastic multiple component fibers described herein by any conventional means. The elastic yarns can be covered with a second yarn, such as a hard yarn. Suitable hard yarns include nylon, acrylic, cotton, polyester and mixtures thereof, among others. Covered yarns can include single covered, double covered, air covered, corespun yarns and core twisted yarns.

The elastic yarns of some embodiments can be included in a variety of constructions such as knits (warp and weft), wovens, and nonwovens. These are useful in hosiery, leg wear, shirting, intimate apparel, swimwear, bottoms and nonwoven hygiene structures.

Test Methods

The strength and elastic properties of the spandex and films were measured in accordance with the general method of ASTM D 2731-72. Three yarns, a 2-inch (5-cm) gauge length, and a 0-300% elongation cycle were used for each of the measurements. The samples were cycled five times at a constant elongation rate of 50 centimeters per minute. Modulus was determined as the force at 100% (M100) and 200% (M200) elongation on the first cycle and is reported in grams. Unload modulus (U200) was determined at 200% elongation on the fifth cycle and is reported in the tables in grams. Percent elongation at break and force at break was measured on the sixth extension cycle.

Percent set was determined as the elongation remaining between the fifth and sixth cycles as indicated by the point at which the fifth unload curve returned to substantially zero stress. Percent set was measured 30 seconds after the samples had been subjected to five 0-300% elongation/relaxation cycles. The percent set was then calculated as % Set=100(Lf−Lo)/Lo, where Lo and Lf are the filament (yarn) length, when held straight without tension, before (Lo) and after (Lf) the five elongation/relaxation cycles.

Friction Coefficient Measurement

When measuring friction coefficient, the spandex yarn 1 was directed from a spandex cake 2, through a first roll 4 and second rolls 6 to provide extension, around a tensiometer 10, across a friction pin 8, and across a second tensiometer 12, and around another godet 14 as illustrated in FIG. 1.

At a given line speed, the apparent coefficient of friction (t) between the fiber and the metal friction pin can be calculated using the following "capstan" equation:

$$f = \ln (T2/T1)/q$$

where T1 is the tension on the fiber just before the metal friction pin, T2 is the tension on the fiber just after the metal friction pin, and q is the angle of contact in radians between the fiber and the metal friction pin. For all examples, q was standardized at 1.047 radians around a 0.25 inch stainless steel pin. For all examples, the unwind speed was a constant 45 m/min with 2.78× draft from first to last roll.

The tension measurements were made using two tension sensors connected to a real-time data acquisition computer, the tension readings were recorded at 5 cm intervals over a 100 meter length of yarn. Friction coefficients in excess of unity can occur with spandex yarns due to contact deformation and adhesive character of elastomers which are not accounted for by the simplified capstan equation.

Figure 2:
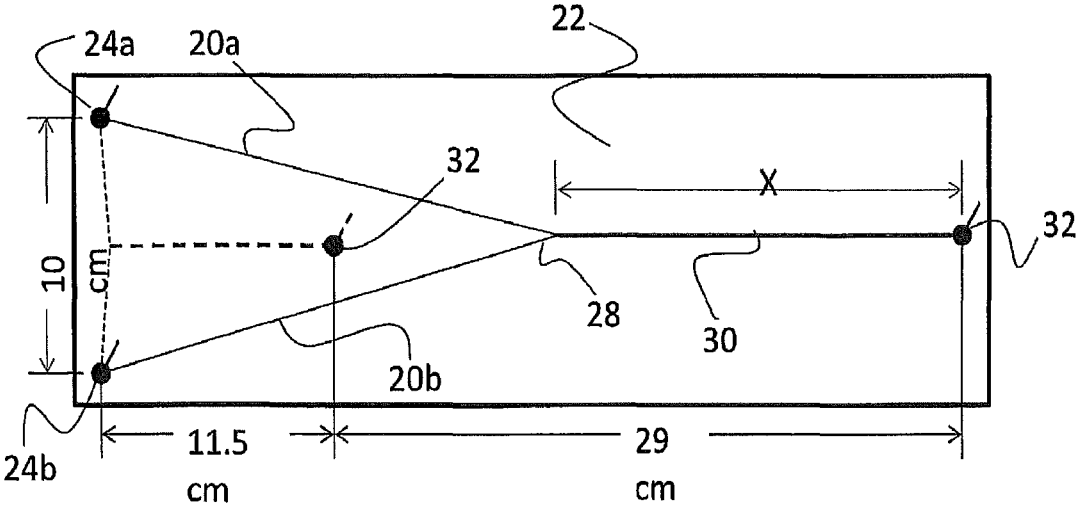
FIG. 2 is a diagram showing yarn placement for measuring cohesive force among filaments in yarn.

Cohesion Index—FIG. 2

To assess the cohesion strength, first remove a sample of multifilament yarn from the package and split filaments by rubbing or stretching. With minimum extension, divide yarn for ~20 cm beyond starting point. Clamp each split end (20*a*, 20*b*) on a board 22 with two pins (24*a*, 24*b*) separated by 10 cm such that the split point 28 is located at 11.5 cm. Each split end (20*a*, 20*b*) and the cohered fiber 30 should be extended straight but relaxed. Place a third clamp 32 at the junction point and steadily elongate the yarn until the third clamp 32 reaches 40.5 cm and allow the split point 28 to equilibrate. With a ruler, measure the length of the cohered yarn to the nearest mm and report as cohesion index. Higher values represent a longer cohered length and stronger inter-filament bonding. The arrangement is depicted in FIG. 2.

The features and advantages of the present invention are more fully shown by the following examples which are provided for purposes of illustration, and are not to be construed as limiting the invention in any way.

EXAMPLES

In the illustrated embodiment of the invention, two different polymer solutions are introduced to a segmented, jacketed heat exchanger operating at 40-90 C. The extrusion dies and plates are arranged according to the desired fiber configuration and illustrated in WO 2010/04515A1 for sheath-core. The fiber of the present invention is produced by dry-spinning a PUU polymer from a solution of N,N-dimethylacetamide (CAS number 127-19-50). In order to provide adequate thermal stability to the final fiber, a high-melt PUU polymer is prepared as follows and is used as basis for core and sheath compositions. A polyurethane prepolymer with a capping ratio of 1.7 was prepared by heating a mixture of MDI ((benzene, 1,1-methylenebis[isocyanato-] CAS number [26447-40-5]) and 1800 number average molecular weight PTMEG (poly(oxy-1,4-butanediyl), α-hydro-ω-hydroxy, CAS number 25190-06-1) to 70-90° C. for 2 hours. The pre-polymer was subsequently dissolved to a level of approximately 35% solids in DMAc. The prepolymer solution was extended with a diamine mixture, preferably of ethylenediamine ("EDA") and 2-methylpentamethylenediamine ("MPMD") to increase the 40° C. falling ball solution viscosity to 3600 poise and form a PUU. The hard segments are the polyurethane/urea parts of the polymer chains; these have melting temperatures of higher than 200° C. The hard segments amount to 5 to 12%, preferably 8 to 10%, of the total weight of the polymer. In the resultant polymer, the soft segments are the polyether/urethane parts of the polymer chain. These soft segments exhibit melting temperatures lower than 25° C.

The polymer solutions containing 30-40% polymer solids are metered through desired arrangement of distribution plates and orifices to form filaments. Distribution plates are arranged to combine polymer streams in a concentric sheath-core arrangement followed by extrusion thru a common capillary. Extruded filaments are dried by introduction of hot gas at 220° C.-440° C. and a gas:polymer mass ratio of at least 10:1 and drawn at a speed of at least 400 meters per minute (preferably at least 600 m/min) and then wound up at a speed of at least 500 meters per minute (preferably at least 750 m/min). Yarns formed from elastic fibers made in accordance with the present invention generally have a tenacity at break of at least 1 cN/dtex, a break elongation of at least 400%, an M200 of at least 0.2 cN/dtex.

Example 1

Talc (Cantal 400) supplied by Canada Talc Ltd., Ontario was dispersed in dimethyl acetamide. A thermoplastic polyurethane, supplied by Bayer Material Science, USA (Desmopan 9375) was dissolved in DMAC and blended with the talc slurry and PUU polymer from above to form a 40% solids solution in DMAc. The solids composition of this solution was 16% talc, 65% thermoplastic polyurethane, and balance PUU polymer. The final solution was extruded as the sheath component along with a core solution consisting of the high-melt PUU polymer in DMAC in a sheath core ratio of 1:9 to form a 44 dtex three-filament yarn. Product was drawn away at 700 m/min and wound on a package at 800 m/min after coating with silicone-based finish oil. Those skilled in the art would recognize the benefit of additional additives such as anti-oxidants, slip agents, and anti-tack agents as necessary to improve commercial value. Product properties including friction, cohesion, and tensile properties are given in Table 1.

Example 2

Boron nitride (Idealube 600) supplied by Saint-Gobain, USA was dispersed in dimethyl acetamide. A thermoplastic polyurethane, supplied by Bayer Material Science, USA (Desmopan 9375) was dissolved in DMAC and blended with the boron nitride slurry and PUU polymer from above to form a 40% solids solution in DMAc. The solids composition of this solution was 10% boron nitride, 55% thermoplastic polyurethane, and balance PUU polymer. The final solution was extruded as the sheath component along with a core solution consisting of the high-melt PUU polymer in a sheath core ratio of 1:9 to form a 44 dtex three-filament yarn. Product was drawn away at 700 m/min and wound on a package at 800 m/min after coating with silicone-based finish oil. Product properties are given in Table 1.

Example 3

Talc (Cantal 400) supplied by Canada Talc Ltd., Ontario was dispersed in dimethyl acetamide. Thermoplastic polyurethane, supplied by Bayer Material Science, USA (Desmopan 9375) was added and blended with the talc slurry and PUU polymer from above to form a 40% solids solution in DMAc. The solids composition of this solution was 16% talc, 65% thermoplastic polyurethane, and balance PUU polymer. The final solution was extruded as the sheath component along with a core solution consisting of the high-melt PUU polymer in a sheath core ratio of 2:8 to form a 20 dtex mono-filament yarn. Product was drawn away at 450 m/min and wound on a package at 560 m/min after coating with silicone-based finish oil. Product properties are given in Table 1.

Comp. Example 1

The prepared PUU polymer as a 36% DMAc solution was extruded without modification as the sheath and core component as a 1:9 ratio to form a 44 dtex three-filament yarn. Product was drawn away at 700 m/min and wound on a package at 800 m/min after coating with silicone-based finish oil. Product properties including friction, cohesion index, and tensile properties are given in Table 1.

Example 4

Cantal 400 supplied by Canada Talc Ltd., Ontario was dispersed in dimethyl acetamide. The talc slurry and PUU polymer from above were blended to form a 38% solids solution in DMAc. The solids composition of this solution was 16% talc, 84% PUU polymer and product omitted any fusing agent from the sheath formulation. The final solution was extruded as the sheath component along with a core solution consisting of the high-melt PUU polymer in a sheath core ratio of 1:9 to form a 44 dtex three-filament yarn. Product was drawn away at 700 m/min and wound on a package at 800 m/min after coating with silicone-based finish oil. Product properties including friction, cohesion, and tensile properties are given in Table 1.

TABLE 1

Properties of low-friction spandex examples and comparative cases

| | | Example 1 | Example 2 | Example 3 | Comp. Ex. 1 | Ex. 4 |
|---|---|---|---|---|---|---|
| Elongation to Break | % | 477 | 485 | 494 | 480 | 482 |
| Teancity at Break | g | 35.2 | 39.7 | 21.4 | 35.1 | 36.1 |
| M200 | g | 4.75 | 4.85 | 2.39 | 5.26 | 5.72 |
| U200 | g | 1.09 | 0.91 | 0.48 | 1.05 | 0.97 |
| Set | % | 24.5 | 27.0 | 30.5 | 26.1 | 23.8 |
| Residual DMAC | w/w % | 0.36 | 0.36 | 0.19 | 0.33 | 0.25 |
| Friction Coefficient | — | 0.47 | 0.44 | 0.39 | 1.31 | 0.75 |
| Friction Coeff (stdev) | — | 0.041 | 0.039 | 0.011 | 0.135 | 0.033 |
| Cohesion Index | cm | 25.4 | 24.7 | na | 20.0 | 0.0 |

Percent set was determined as the elongation remaining between the fifth and sixth cycles as indicated by the point at which the fifth unload curve returned to substantially zero stress. Percent set was measured 30 seconds after the samples had been subjected to five 0-300% elongation/relaxation cycles. The percent set was then calculated as:

$$\% \text{ Set}=100(Lf-Lo)/Lo,$$

where Lo and Lf are respectively the filament (yarn) length, when held straight without tension, before (Lo) and after (Lf) the five elongation/relaxation cycles.

The reason for the higher friction measurement for Example 4, compared to examples 1 and 2, is due to the poor coalescence of the 3-filament yarn of Example 4. The fully coalesced fiber of Ex. 1 and 2 will print two filaments at a time on the steel pin used for measurement, while a yarn without the fusing agent will print three filaments. Thus theoretical friction increase should be about 50% higher.

While there have been described what are presently believed to be the preferred embodiments of the invention, those skilled in the art will realize that changes and modifications may be made thereto without departing from the spirit of the invention, and it is intended to include all such changes and modifications as fall within the true scope of the invention.

What is claimed is:

1. An article comprising woven, nonwoven, warp knit or weft knit solution spun spandex elastomeric yarn, said yarn solution spun from a polymer solution containing 30-40% polymer solids and comprising:

(a) a polyurethane bicomponent fiber having a core and a sheath; and (b) a lubricating additive of crystalline material selected from the group consisting of mica, graphite, molybdenum disulfide, boron nitride and mixtures thereof which shears into thin, flat platelets which slide over one another and creates a lubricating effect;

wherein:

(a) the elastomeric yarn is a single filament yarn;

(b) the sheath comprises:

(i) about 1% to about 60% by weight of the fiber; and (ii) the lubricating additive in an amount from about 1% to about 25% by weight of the sheath; and (iii) a polyurethane-urea; and (c) the core comprises:

(i) a polyurethane with a high melting point of 200° C. or higher;

(ii) a blend of at least one polyurethane and at least one polyurethane-urea; or (iii) a polyurethane-urea with a melting point of 240° C. or higher, said yarn exhibiting a reduced friction coefficient as compared to yarn without the lubricating additive, a break elongation of at least 400% and an unload modulus at 300% elongation of at least 27 mg/dtex.

2. The article of claim 1, wherein the lubricating additive comprises boron nitride.

3. The article of claim 1, wherein said lubricating additive is boron nitride.

4. The article of claim 1, wherein said sheath comprises a fusing additive in an amount from about 50% to about 70%.

5. The article of claim 1, wherein said sheath comprises a fusing additive in an amount from about 60% to 65%.

6. The article of claim 1, wherein said sheath comprises about 1% to about 50% by weight of the fiber.

7. The article of claim 1, wherein said sheath comprises about 10% to 20% by weight of the fiber.

8. The article of claim 4, wherein the fusing additive is selected from linear thermoplastic polyurethanes, adhesives, and mixtures thereof.

9. The article of claim 1, wherein said article is a fabric.

10. The article of claim 1, wherein said article is a garment.

11. An article comprising woven, nonwoven, warp knit or weft knit solution-spun spandex elastomeric yarn, said yarn solution spun from a polymer solution containing 30-40% polymer solids and comprising:

(a) a polyurethane bicomponent fiber having a core and a sheath;

(b) a lubricating additive of crystalline material selected from the group consisting of mica, graphite, molybdenum disulfide, boron nitride and mixtures thereof which shears into thin, flat platelets which slide over one another and creates a lubricating effect; and (c) a fusing additive to enhance cohesive bonding between filaments;

wherein:

(a) said elastomeric yarn is a multiple filament yarn;

(b) the sheath comprises:

(i) about 1% to about 60% by weight of the fiber; and (ii) the lubricating additive in an amount from about 1% to about 25% by weight of the sheath;

(iii) the fusing additive; and (iv) a polyurethane-urea; and (c) the core comprises:

(i) a polyurethane with a high melting point ranging from 200° C. to 250° C.;

(ii) a blend of at least one polyurethane and at least one polyurethane-urea; or (iii) a polyurethane-urea with a melting point greater than 240° C., said yarn exhibiting a reduced friction coefficient as compared to yarn without the lubricating additive, a break elongation of at least 400% and an unload modulus at 300% elongation of at least 27 mg/dtex.

12. The article of claim 11, wherein the lubricating additive comprises boron nitride.

13. The article of claim 11, wherein said lubricating additive is boron nitride.

14. The article of claim 11, wherein the fusing additive is in an amount from about 50% to about 70% by weight of the sheath.

15. The article of claim 11, wherein the fusing additive is in an amount from about 60% to 65% by weight of the sheath.

16. The article of claim 11, wherein said sheath comprises about 1% to about 50% by weight of the fiber.

17. The article of claim 11, wherein said sheath comprises about 10% to 15% by weight of the fiber.

18. The article of claim 11, wherein said article is a fabric.

19. The article of claim 11, wherein said article is a garment.

20. The article of claim 1 further comprising an additive providing one or more beneficial properties selected from the group consisting of hydrophobicity, hydrophilicity, friction control, chlorine resistance, adhesiveness, barrier, tensile properties, recyclability, biodegradability, fragrance, tactile properties, set-ability, thermal regulation and nutriceutical.

21. The article of claim 11, wherein the fusing additive is added in an amount from about 25% to about 75% by weight of the sheath.

22. An article comprising woven, nonwoven, warp knit or weft knit solution spun spandex elastomeric yarn, said yarn solution spun from a polymer solution containing 30-40% polymer solids and comprising:

(a) a polyurethane bicomponent fiber having a core and a sheath; and (b) a lubricating additive of crystalline material selected from the group consisting of mica, graphite, molybdenum disulfide, boron nitride and mixtures thereof which shears into thin, flat platelets which slide over one another and creates a lubricating effect;

wherein:

(a) the elastomeric yarn is a single filament yarn;

(b) the sheath consists essentially of:

(i) about 1% to about 60% by weight of the fiber;

(ii) the lubricating additive in an amount from about 1% to about 25% by weight of the sheath;

(iii) an additive that provides one or more beneficial properties selected from the group consisting of hydrophobicity, hydrophilicity, friction control, chlorine resistance, fusibility, barrier, tensile properties, recyclability, biodegradability, fragrance, tactile properties, set-ability, thermal regulation and nutriceutical; and (iv) a polyurethane-urea; and (c) the core comprises:

(i) a polyurethane with a high melting point of 200° C. or higher;

(ii) a blend of at least one polyurethane and at least one polyurethane-urea; or iii) a polyurethane-urea with a melting point of 240° C. or higher, said yarn exhibiting a reduced friction coefficient as compared to yarn without the lubricating additive, a break elongation of at least 400% and an unload modulus at 300% elongation of at least 27 mg/dtex.

23. The article of claim 22, wherein the sheath consists of:

(i) about 1% to about 60% by weight of the fiber;

(ii) the lubricating additive in an amount from about 1% to about 25% by weight of the sheath;

(iii) the additive that provides one or more beneficial properties selected from the group consisting of hydrophobicity, hydrophilicity, friction control, chlorine resistance, fusibility, barrier, tensile properties, recyclability, biodegradability, fragrance, tactile properties, set-ability, thermal regulation and nutriceutical; and (iv) a polyurethane-urea.

* * * * *